United States Patent [19]

Sakoda et al.

[11] 3,963,818

[45] June 15, 1976

[54] WATER SOLUBLE CORE FOR PRESSURE DIE CASTING AND PROCESS FOR MAKING THE SAME

[75] Inventors: Tadami Sakoda; Tetsuhiko Suzuki, both of Hiroshima, Japan

[73] Assignee: Toyo Kogyo Co., Ltd., Hiroshima, Japan

[22] Filed: Mar. 27, 1974

[21] Appl. No.: 455,091

Related U.S. Application Data

[63] Continuation of Ser. No. 193,983, Oct. 29, 1971, abandoned.

[52] U.S. Cl. ..... 264/56; 264/66; 264/221

[51] Int. Cl. ..... C04b 35/64; B29c 1/02

[58] Field of Search ..... 264/66, 56, 221, DIG. 44; 164/61

[56] References Cited

UNITED STATES PATENTS 3,356,129 12/1967 Anderko ..... 264/56

OTHER PUBLICATIONS

Kingery, *Introduction to Ceramics*, pp. 39–47, p. 622 (1960).

*Primary Examiner*—Donald J. Arnold
*Assistant Examiner*—John Parrish
*Attorney, Agent, or Firm*—Sughrue, Rothwell, Mion, Zinn & Macpeak

[57] ABSTRACT

Process for producing a water-soluble core for pressure die casting by pre-drying a granular water-soluble salt having grain size of less than about 1000 microns so that the moisture content thereof becomes less than 1%, molding under compression the granular water-soluble salt into a desired shape and volume at a pressure of between about 1.5-4 tons/cm.$^2$, and if necessary, sintering the molded salt at a temperature of between about 100°-300°C. The core for pressure die casting acting as a cavity former within a casting and substantially consisting of a water-soluble salt and having a compressive strength of between about 800-1480 kg./cm.$^2$, a bending strength of between about 200–370 kg./cm.$^2$, and a density of between 2.05–2.12.

2 Claims, No Drawings

WATER SOLUBLE CORE FOR PRESSURE DIE CASTING AND PROCESS FOR MAKING THE SAME

This is a continuation of application Ser. No. 193,983, filed Oct. 29, 1971.

BACKGROUND OF THE INVENTION

1. Field of the Invention

The present invention relates to a water-soluble core for pressure die casting and a process for producing the core. More particularly, the invention relates to a water-soluble core for pressure die casting having a desired strength prepared by compression molding a granular water-soluble salt.

2. Description of the Prior Art

In case of casting metallic castings containing cavities by normal pressure or low pressure casting, such as sand mold casting, gravity die casting, low pressure die casting, etc., a casting having complicated cavities has hitherto been readily produced using a known sand core prepared by bonding sand grains with a caking agent, such as a synthetic resin. However, in the case of casting a metallic casting containing cavities in a pressure die casting method in which a molten metal such as an aluminum alloy, a zinc alloy, etc., is poured in a precise metallic die under a high pressure of a few hundreds kg./cm.$^2$ or higher, and cores other than those having high strength and capable of being readily removed after casting are unsuitable in this method. Various cores for pressure die casting having such properties have hitherto been proposed but they each have difficulties and the cores which can be satisfactorily used for the purpose, have hitherto not been available.

For example, there is known a casting method in which a core of a Zn-base alloy is used as the core for die casting aluminum or aluminum alloy and after casting the core is melted away by heating, but is such a method, the core is partially washed away by pouring the molten metal and furthermore, the complete removal of the core is difficult. Also, it is known to use a water-soluble core prepared by melting and molding a mixture of sodium metasilicate ($Na_2O.SiO_2$) and sodium disilicate ($Na_2O.2SiO_2$) but the use of the core is accompanied with the flaw that at the dissolution of the core, its aqueous solution is brought into a strongly alkaline state and erodes aluminum, zinc, etc. Furthermore, a water-soluble core prepared by melting and molding sodium chloride or calcium chloride is known, but a core made of sodium chloride will shrink during molding and the production of such a core having a high dimensional precision is quite difficult. A core made of calcium chloride is subject to the characteristics of a high hygroscopic property such that the core after molding is required to be maintained at a temperature of at least 200° C. before being used for casting.

Still further, a method of producing a salt-type core by compression-molding a sodium chloride or potassium chloride powder at a pressure of 300–500 kg./cm.$^2$ and then sintering the molding at 500°–750° C. for 0.5–2 hours is disclosed in the specification of the Anderko U.S. Pat. No. 3,356,129, but the core shown in the Anderko patent is for a gravity die casting of pistons, etc., and has low strength, which makes the core unapplicable for pressure die casting. That is, in a casting method requiring a core of high precision, such as pressure die casting, the core produced by sintering a salt at a high temperature between 500°–750° C. for a long period of time as in the aforesaid method, cannot be applied since the dimensional precision of the core is greatly reduced at the production thereof besides the high production cost thereof.

SUMMARY OF THE INVENTION

An object of this invention is, therefore, to provide a core as a cavity former within a casting in a pressure die casting method, which is not accompanied with the above-mentioned faults, is made of an inexpensive material, and has the necessary strength for pressure die casting.

Another object of this invention is to provide a core as a cavity former within a casting in a pressure die casting method, which is made of a water-soluble salt capable of being washed away by only applying water.

Still another object of this invention is to provide a process for making a core as a cavity former within a casting in a pressure die casting method by molding under compression a granular water-soluble salt.

A further object of this invention is to provide a process for making a core as a cavity former within a casting in a pressure die casting method by molding under compression a granular water-soluble salt and then sintering the molding.

Another object of this invention is to provide a core as a cavity former within a casting in a pressure die casting method, which has a high dimensional precision and the smooth surface.

Other objects and advantages of the present invention will become apparent from the following description and the accompanying examples.

DESCRIPTION OF THE PREFERRED EMBODIMENT

According to the process of this invention, a granular water-soluble salt, such as sodium chloride, potassium chloride, and the like, is pre-dried and molded under compression in a press mold, etc., at a pressure of between about 1.5–4 tons/cm.$^2$ into a desired shape.

Also, according to another embodiment of the process of this invention, the core molded under compression in the above process is further sintered at temperatures of from about 100° C. to about 300° C.

The core of this invention thus produced has a compressive strength of between about 700–1000 kg./cm$^2$ by only the compression molding process and a compressive strength of between about 1000–1500 kg./cm.$^2$ after sintering, endures sufficiently a molten metal pressure of a few hundreds kg./cm.$^2$, can be readily dissolved away by water washing, and also the aqueous solution used for the washing does not erode aluminum, zinc, etc. Thus, the core of this invention is particularly suitable as a core for pressure die casting.

It is desirable that the powder of an inorganic salt, such as sodium chloride, potassium chloride, etc., used in this invention has a grain size of less than 1000 microns, preferably 40–100 American Foundry Standard Grain Fineness Number in grain size index, and has a broad grain size distribution. This is because if the grain size of the powder is too fine, the fluidity of the powder is reduced to degrade the filling property thereof in mold and a so-called capping phenomenon occurs at molding to form cracks in the direction perpendicular to the compressed direction of the core, while if the grain size of the powder is too coarse, the physical strength and the density of the core are reduced. Accordingly, a powder of about 40–100 American Foundry Standard Grain Fineness number is preferable for moldability and strength and in particular, it has been found that when a mixture of coarse and fine powders of the above grain size range that has a broad grain size distribution is used, the strength of the core obtained can be increased by 20–40%. That is, when a mixture of salt of Grain Fineness Number 37 and Grain Fineness Number 100 is used, the strength of the core obtained can be increased by 20 to 40%.

Furthermore, if the moisture content in the powder is high, the fluidity of the powder or the filling property of the powder is reduced to lower greatly the strength of the core and thus it is necessary to subject the powder to pre-drying, for example, to dry preliminarily the powder for 10–60 minutes at a temperature between about 80°–120° C. to reduce the moisture content thereof below 1%. If the grain size of the powder is coarser and the molding pressure is higher, the moisture content of the powder greatly effects the strength of the core made of the powder. For example, the strength of the core prepared by molding under compression at a pressure of 2 tons/cm$^2$ a powder having a moisture content of 2% is lower than that of the core produced from a powder having a moisture content of 1% by about 20%, but when the powders having moisture contents of less than 1% are employed, the difference in moisture content does not give such an influence, as above, on the strength of core.

Also, it is required for producing a core having a strength suitable for pressure die casting that the molding pressure be at least 1.5 tons/cm.$^2$ but even if the molding pressure is higher than, for example, 5 tons/cm.$^2$, the strength and density of the core are hardly increased as well as the aforesaid capping phenomenon occurs to provide inferior products. Therefore, the practical range of the molding pressure is generally lower than 4 tons/cm.$^2$ which can maintain the yield for such inferior articles less than 10% and usually the best result is obtained in a pressure range of from 1.8 to 2.5 tons/cm.$^2$. In addition, in the case of producing the core for pressure die casting having sufficient strength only by compression molding, a molding pressure of higher than 1.8 tons/cm.$^2$ is necessary.

The core obtained by compression molding an inorganic salt powder has a sufficient strength even before sintering and may be sufficiently practices as a core for pressure die casting, but when the core is further sintered at temperatures between about 100°–300° C., the strength thereof can be increased more than 50%. In this case, if the sintering temperature is lower than 100° C., the strength increasing effect can not be obtained, while if the sintering temperature is too high, a thermal deformation occurs which makes it difficult to maintain the dimensional precision of the core as well as increasing the cost involved. Therefore, the preferable upper limit of the sintering temperature is about 300° C. The sintering period of time depends largely upon the size of the core to be sintered but is preferable, in general, between 10–60 minutes.

The experimental results on the compressive strength, bending strength, and density of core are disclosed below. The raw material for the core used was prepared by mixing a powder of industrial salt (containing 95% NaCl, 2% water, and 3% impurities) having a grain size index of American Foundry Standard Grain Fineness Number 37 prepared by crushing the salt and a powder of the same industrial salt having a grain size index of American Foundry Standard Grain Fineness Number 93 in a weight ratio of 30:70 and drying the mixture so that the moisture content of it became less than 0.5%. The measurements were conducted on the core produced by charging the above mixture in a press mold and molding at a pressure of 1.5–4 tons/cm.$^2$ according to the process of this invention and the core produced by further sintering the above core for 20 minutes at 200° C. according to the other embodiment of the process of this invention. The results of the measurements are shown in the following table, in which the compressive strength was measured about the columnar specimen of 40 mm. in diameter and 40 mm. in length and the bending strength was measured about a rectangular pillar shaped specimen of 10 × 10 × 55 mm.$^3$ with a distance between the supported points of 45 mm.

Table 1

| | | Pressure (ton/cm.$^2$) 1.5 | 1.8 | 2 | 4 |
|---|---|---|---|---|---|
| Not sintered | Density | 2.05 | 2.08 | 2.09 | 2.12 |
| | Compressive strength(kg/cm$^2$) | 720 | 800 | 820 | 1050 |
| | Bending strength (kg./cm$^2$) | 120 | 200 | 210 | 230 |
| Sintered | Compressive strength(kg/cm$^2$) | 1080 | 1350 | 1480 | |
| | bending strength (kg/cm$^2$) | 200 | 300 | 340 | 370 |

The core used for pressure die casting is required to have a bending strength of higher than 200 kg./cm.$^2$ and a compressive strength of higher than few hundreds kg./cm.$^2$ and the cores produced by the invention satisfy sufficiently these conditions.

A core was also produced by drying the powder of the same industrial salt as above, having a grain size index of American Foundry Standard Grain Fineness Number 64 by the same manner as above, molding at a pressure of 400 kg./cm.$^2$, and sintering for 1 hour at 600° C. according to the process of the Anderko patent mentioned above and the properties of the core were compared with those of the cores of this invention prepared above, the results of which are shown in Table 2 and Table 3.

Table 2

| | Compressive strength (kg./cm$^2$) Before sintering | After sintering | Bending strength (kg./cm$^2$) Before sintering | After sintering |
|---|---|---|---|---|
| Product of this invention | 820 | 1350 | 210 | 340 |
| Product of Anderko patent | 65 | 230 | 17 | 83 |

Table 3

| | Density (g./cm.³) | Porosity (%) | Surface roughness (BMS micron) |
|---|---|---|---|
| Product of this invention | 2.09 | 3.0 | 7 |
| Product of Anderko patent | 1.61 | 25.7 | 90 |

As is clear from the above tables, the cores of this invention have remarkably high strength and can be sufficiently used for pressure die casting, whereas the cores of the Anderko patent type have insufficient strength for pressure die casting and hence are inapplicable for the purpose. Furthermore, the core of the Schmidt patent had to be handled with a great deal of care before sintering since the strength thereof before sintering was low, while the core of this invention gave no such troubles even before sintering.

Moreover, it has been found that the cores of this invention are excellent in surface smoothness, have a high dimensional precision, and are particularly suitable as a core for producing pressure die casted articles having beautiful casting surfaces. On the other hand, the core produced by the process of the Anderko patent was quite inferior in surface smoothness and could not effectively be used for pressure die casting. Considering this point, together with the point of strength, it will be understood that the core of the Anderko patent is a core adaptable only for gravity casting.

The invention will be further explained by referring to the following examples.

EXAMPLE 1

In the example a core used for producing water pump bearing housings of an aluminum alloy as a part of a motorcar engine by pressure die casting was produced.

A powder of industrial salt containing 95% sodium chloride and 2% water having a grain size index of American Foundry Standard Grain Fineness Number 64 prepared by crushing the salt in a ball mill for 15 minutes was dried for 30 minutes at 100° C., placed in a mold, molded under compression at a pressure of 1.8 tons/cm² by means of a crank press, and sintered for 20 minutes at 150° C. to provide a ring-shaped core of 20 mm. in inside diameter, 48 mm. in outside diameter, and 6 mm. in thickness. In a die casting composed of an outer mold and inner mold and equipped to a die casting machine of 250 tons, the core was mounted on the inner mold and after closing the die, a molten aluminum alloy was introduced in the cavities of the die through the gate thereof at a pressure of 1000 kg./cm.². In this case, the speed of the molten metal was 20 meters/sec. at the gate. When the casted article was withdrawn and water was poured onto the core through a hose having an inside diameter of 15 mm. at a pressure of 2 kg./cm.², the core was completely dissolved away within one minute to provide a die-cast article. The core of this invention thus produced could endure the pressure of a molten metal, without either breakage nor deformation, and had no surface defects.

EXAMPLE 2

In this example, a core used for producing water pump covers of an aluminum alloy as a part of a motorcar engine by pressure die casting was produced.

A mixture of a powder having a grain size index of American Foundry Standard Grain Fineness Number 37 and a powder having a grain size index of American Foundry Standard Grain Fineness Number 93 produced by crushing the same raw material as used in Example 1 for 20 minutes in a ball mill in a weight ratio of 30:70 was dried so that the moisture content thereof became less than 0.5%, placed in a mold, molded under compression at a pressure of 2.2 tons/cm.² by means of a hydraulic press, and then sintered for 30 minutes in a hot atmosphere of 200° C. to provide a core having the almost same dimensions and shape as in Example 1. The core was mounted on a die and a molten aluminum alloy was introduced in the die at a pressure of 1200 kg./cm.². The cast article thus formed was withdrawn and water was poured onto the core through a hose having an inside diameter of 15 mm. at a pressure of 2 kg./cm², whereby the core was completely dissolved away within one minute to provide a die cast article. It was found as the results of the experiments that the core was quite satisfactory for pressure die casting.

As mentioned above, a principal feature of the process of this invention for producing a water-soluble core for pressure die casting is in the fact that a powder of a water-soluble inorganic salt, such as sodium chloride, potassium chloride, etc., is pre-heated so that the moisture content of it becomes less than 1%, placed in a mold, molded under compression at a pressure of 1.5–4 tons/cm.², and, if necessary, sintered at temperatures of 100°–300° C.

The core of this invention has a high strength, has a smooth surface, causes neither surface defects nor gas defects in the article cast by using the core, can be readily dissolved away by water after casting, and can be allowed to stand for several months without becoming deteriorated with the passage of time, that is, the core can be stored for a long period of time.

What is claimed is:

1. A process for preparing a water-soluble core to act as a cavity former in a pressure die casting process which comprises the steps of:

1. preparing an inorganic water-soluble salt consisting predominantly of sodium chloride or potassium chloride and having a grain size of 40 to 100 American Foundary Standard Grain Fineness Number, said salt containing a moisture content of less than 1% in weight,
2. placing said salt from step 1 in a mold,
3. compressing said salt with a pressure between 1.8 and 4.0 tons per cm², and
4. removing the completed core from the mold, thereby obtaining a core characterized by a bending strength of between 200 and 230 Kg/cm² for use as a cavity former in a pressure die casting process.

2. A process for preparing a water-soluble core to act as a cavity former in a pressure die casting process which comprises to steps of:

1. preparing an inorganic water-soluble salt consisting predominantly of sodium chloride or potassium chloride and having a grain size of 40 to 100 American Foundary Standard Grain Fineness Number, said salt containing a moisture content of less than 1% by weight,
2. placing said salt in a mold,
3. compressing said salt with a pressure of between 1.5 and 4.0 tons per cm²,
4. sintering said salt for 10 to 60 minutes at 100° to 300° C., and
5. removing the completed core from the mold, thereby obtaining a core characterized by a bending strength of between 200 and 370 Kg/cm² for use as a cavity former in a pressure die casting process.

* * * * *